United States Patent [19]

Foster et al.

[11] Patent Number: 5,054,692

[45] Date of Patent: Oct. 8, 1991

[54] FLUID DISCHARGE APPARATUS

[75] Inventors: Donald D. Foster, St. Charles; Harry T. Auer, St. Peters, both of Mo.

[73] Assignee: Contico Internation, Inc., St. Louis, Mo.

[21] Appl. No.: 533,454

[22] Filed: Jun. 5, 1990

[51] Int. Cl.[5] ..... B05B 1/00

[52] U.S. Cl. ..... 239/589; 239/590; 239/590.5; 239/601

[58] Field of Search ..... 239/589, 590, 590.5, 239/601, 390, 391, 397, 337

[56] References Cited

U.S. PATENT DOCUMENTS

| | | | |
|---|---|---|---|
| 3,785,571 | 1/1974 | Hoening | 239/337 |
| 4,350,298 | 9/1982 | Tada . | |
| 4,463,905 | 8/1984 | Stoesser et al. . | |
| 4,706,888 | 11/1987 | Dobbs . | |
| 4,815,663 | 3/1989 | Tada . | |

FOREIGN PATENT DOCUMENTS

| | | |
|---|---|---|
| 117898 | 9/1984 | European Pat. Off. . |

*Primary Examiner*—Andres Kashnikow

*Assistant Examiner*—Lesley D. Morris

*Attorney, Agent, or Firm*—Sandler, Greenblum & Bernstein

[57] ABSTRACT

A fluid discharge apparatus for imparting a stream configuration to a current of fluid. The fluid discharge apparatus includes a nozzle containing a passageway having at least a receiving portion with a substantially rectilinear cross-section and an issuing portion with a substantially curvilinear cross-section, such that a fluid current passing through the passageway emerges therefrom in a stream configuration.

The nozzle may be pivotably connected to a second nozzle. The second nozzle is adapted for incorporation into a sprayer-type fluid dispenser, and contains a second passageway. Pivoting of the first nozzle towards, and its consequent attachment to, the second nozzle brings the first and second passageways into sealed communication. This permits the fluid current generated by the sprayer apparatus to be dispensed as either a spray, when the first nozzle is not attached to the second nozzle, or as a stream, when the first nozzle is so attached.

28 Claims, 2 Drawing Sheets

FLUID DISCHARGE APPARATUS

1. Field of the Invention

The present invention is directed to a fluid discharge apparatus for imparting a stream configuration to a current of fluid.

More particularly, the present invention is directed to a fluid discharge apparatus which includes a nozzle containing a passageway whose cross-section includes both substantially curvilinear and substantially rectilinear portions, such that a current of fluid passing through the passageway emerges therefrom in a stream configuration.

2. Description of Background and Relevant Materials

Fluid dispensers, such as pump bottles, pump spray bottles, and in particular trigger sprayer bottles, are used to dispense a broad range of substances. Those substances include hand, face, and body lotions; and, cleaners for materials as diverse as wood, glass, vinyl, leather, suede, metals (such as aluminum, copper, brass, silver, and chrome), rubber (such as automobile tire brighteners), formica, ceramics, stainless steel, fabrics, painted surfaces, and the like.

With the general exception of lotions, fluid dispensers are typically used to dispense liquids such as cleaning solutions. Because of the varied environments in which such dispensers may be used, and the extremely wide range of surfaces to which they may be applied, it is generally considered desireable to enable the user to select between different configurations of the discharged fluid. Most commonly, this selection provides the user with a choice between a stream configuration, wherein the fluid is projected from the dispenser in a substantially coherent, cylindrical stream, and a spray configuration, wherein the fluid disperses in a substantially conical, expanding shape, which may be composed of discrete droplets or mist.

In the sprayer category of fluid dispensers, such as exemplified by the hand-held trigger-type sprayer bottle, the normal or default configuration in which the fluid emerges from the sprayer discharge orifice is a spray. The spray is effected by imparting a radial spinning movement to the current of fluid as it moves along the discharge passageway towards the discharge orifice. When the fluid passes through the orifice and exits the sprayer, the spinning motion causes the fluid to disperse radially, while the forward momentum imparted by the sprayer trigger mechanism causes the fluid to project forward, resulting in the expanding conical body of droplets characteristic of a spray. (See, for example, TADA, U.S. Pat. No. 4,815,663, and European Patent Application No. 83110619.0, Publication No. 0 117 898, for illustrations and discussions of trigger-type sprayers.)

Various attempts have been made to provide the user of a fluid dispensing apparatus with a selection of configurations in which the fluid may be dispensed. STOESSER et al., U.S. Pat. No. 4,463,905, is directed to a foam-spraying apparatus wherein a liquid is first ejected from a hand dispensing pump through an atomizing nozzle, forming a spray, and the spray thus formed is then passed through foam-forming means. The foam-forming means includes a housing and a screen, and is operatively associated with the dispensing pump by a snap-fit mechanism (see, e.g., column 4, lines 42 et seq.).

TADA, U.S. Pat. No. 4,350,298, is directed to an improvement in the nozzle cap of a foam dispenser, whereby the nozzle cap includes a plurality of arms forming an obstacle with which a liquid sprayed from an orifice of the foam dispenser collides. A plurality of foam outlet ports is provided between adjacent arms. The nozzle cap is moveable relative to the foam dispenser body between a sealing and a foaming position, and may be formed integrally with the foam dispenser nozzle through a hinge (see, e.g., column 3, lines 14 et seq., and claim 1).

More particularly, attempts have been made to provide a mechanism whereby the output of a fluid dispenser may be switched between stream and spray, in order to provide the user with more flexibility in fitting the fluid outflow to the task at hand. DOBBS, U.S. Pat. No. 4,706,888, is directed to use of a rotatable nozzle cap having a plurality of longitudinal grooves which communicate with alternating radial and tangential channels. Rotation of the nozzle cap controls whether the fluid current passes along the longitudinal grooves and through the radial channels, producing a stream, or through the tangential channels, which impart a spin to the fluid current and produce a spray.

However, the rotatable nozzle cap of DOBBS is relatively complex, and will have correspondingly high fabrication costs. There is also an inherent inconsistency between the clearance required between the nozzle cap and the plug, which is essential to permit rotation of the cap, and the integrity of the seal between the nozzle cap and the plug required to prevent discharged liquid from leaking into the space between the two rather than passing through the longitudinal passages. Furthermore, and with reference to FIG. 4 of DOBBS, fairly precise alignment is required between passages 32 and grooves 27 to fully permit discharge of the fluid. In view of the tolerances involved, even a slight misalignment may significantly impede the flow of fluid.

These problems would, moreover, appear to be inherent in all spray/stream dispensers wherein the change between spray and stream is accomplished by rotating an assembly associated with the dispenser discharge orifice. In particular, this category of rotatable assemblies must all compromise between the incompatible goals of permitting the user to rotate the assembly with ease, and at the same time providing an absolute seal between the assembly and the dispenser to prevent fluid leakage.

It would therefore be desireable to provide a mechanism whereby a user may conveniently and easily convert a fluid current to a stream configuration, without compromising the integrity of the fluid dispenser.

SUMMARY OF THE INVENTION

In accordance with the above, there is provided by the present invention a fluid discharge apparatus for imparting a stream configuration to a current of fluid. The fluid discharge apparatus comprises a nozzle containing a passageway having at least a receiving portion with a substantially rectilinear cross-section, and an issuing portion with a substantially curvilinear crosssection. A fluid current passing through the passageway thereby emerges from it in a stream configuration.

The receiving portion and the issuing portion may be adjacent each other. The receiving portion may have a cross section substantially in the shape of a polygon. In particular, the polygon, which may be a regular polygon, may be selected from the group consisting of a triangle (which may be an isosceles or equilateral triangle, but is not limited to either), a rectangle, a square, a pentagon, a hexagon, a septagon, an octagon, a trapezoid, and a parallelogram. The issuing portion may have a cross section selected from the group consisting of a circle, an oval, and an ellipse.

Preferably, the issuing portion has a cross section substantially in the shape of a circle, and the receiving portion has a cross-section substantially in the shape of a polygon, most preferably a square. Each side of the polygon should have a length at least equal to the diameter of the circle, and the circumference of the polygon should be no less than the circumference of the circle.

In another embodiment, the nozzle and passageway described above may constitute a first nozzle and a first passageway, and the present invention may include a second nozzle having a second passageway adapted to receive the fluid current from a fluid dispensing apparatus, the second nozzle being adapted for attachment to the fluid dispensing apparatus. The first nozzle may include a hinge portion flexibly connecting the first nozzle to the second nozzle, such that the first nozzle is moveable with respect to the second nozzle between an attached position, wherein the first passageway is in sealed communication with the second passageway, and a non-attached position, wherein the first nozzle is sufficiently distanced from the second passageway to avoid contact with fluid emerging from the second passageway.

In this embodiment, the fluid discharge apparatus preferably includes means for maintaining the first passageway in sealed communication with the second passageway. The means for maintaining may comprise at least one locking projection on the first nozzle and at least one pair of abutments on the second nozzle. The locking projection and the abutments are configured and positioned such that rotation of the first nozzle about the hinge portion to bring the first passageway into sealed communication with the second passageway causes the locking projection and the abutments to become operatively engaged, maintaining the first nozzle in the attached position. Preferably, there are two locking projections on the first nozzle and two pairs of corresponding abutments on the second nozzle. The first nozzle preferably has at least one projecting tab for rotating the first nozzle about the hinge portion.

In a further embodiment, the present invention extends to a fluid dispenser comprising a fluid container, a fluid dispensing apparatus adapted for attachment to the fluid container, and the fluid discharge apparatus containing the first nozzle and second nozzle as described above, wherein the second nozzle is adapted for attachment to the fluid dispensing apparatus.

Means may be provided for sealing the first passageway to prevent fluid from discharging therefrom during shipping or storage of the fluid dispenser. To this end, the first passageway may include a discharge portion where the current of fluid passes from the first passageway into the ambient environment. The means for sealing may then include an external cap adapted to sealingly attach to the discharge portion.

In a preferred embodiment, the discharge portion comprises a cylindrical projection having an exterior raised annulus, and the external cap has an interior raised annulus. The interior raised annulus is so positioned and dimensioned on the external cap as to first engage, and then snap over, the exterior raised annulus when the external cap is pressed onto the discharge portion, thereby sealing the first passageway. The external cap may include a projection on its interior end wall, the projection being positioned and configured so as to sealingly engage the discharge orifice of the first passageway when the external cap is pressed onto and sealed to the discharge portion.

A fluid discharge apparatus for imparting a stream configuration to a radially spinning fluid current generated by a sprayer-type fluid dispenser, comprising:

a second nozzle having a second passageway adapted to receive the fluid current, the second nozzle being adapted for attachment to the sprayer-type fluid dispenser; and a first nozzle containing a first passageway, the first nozzle being connected to the second nozzle and further being moveable with respect to the second nozzle between a attached position wherein the first passageway is in sealed communication with the second passageway, and a non-attached position wherein the first nozzle is sufficiently distanced from the second passageway to avoid contact with fluid emerging from the second passageway, the first passageway comprising:

a second, substantially circular portion adapted to receive the fluid current from the second passageway when the first nozzle is connected to and communicating with the second passageway;

a first, substantially polygonal portion communicating with the second, substantially circular portion; and a second, substantially circular portion communicating with the first, substantially polygonal portion, whereby the radially spinning fluid current passes from the second passageway into the second, substantially circular portion; is substantially deprived of coherent radial spin upon entering and passing through the first, substantially polygonal portion; and is re-formed into a substantially non-spinning, cylindrical fluid current upon entering and passing through the second, substantially circular passageway, thereby emerging from the second, substantially circular passageway as a substantially coherent, cylindrical fluid stream.

BRIEF DESCRIPTION OF FIGURES

FIG. 1 is a cross-section through one embodiment of the nozzle according to the present invention. The crosssection is taken along a plane intersecting the axis of passageway 2.

FIG. 2 shows a longitudinal cross-section through the nozzle of the present invention, depicted as first nozzle 1, connected to second nozzle 7. Second nozzle 7 is adapted for incorporation into a fluid dispenser, such as a trigger-type sprayer bottle.

FIG. 4 provides a longitudinal cross-section through first nozzle 1 in its position of attachment to second nozzle 7, and also shows external cap 13 affixed to the first nozzle.

FIG. 5 depicts various illustrative rectilinear cross sections which may be used in forming receiving portion 3 of first nozzle 1.

FIG. 6 depicts various illustrative curvilinear cross sections which may be used in forming issuing portion 4 of first nozzle 1.

FIG. 7 portrays an embodiment of the present invention wherein the nozzle is attached to a fluid dispensing apparatus, which is in turn attached to a fluid container.

DESCRIPTION OF PREFERRED EMBODIMENTS

Figure 3:
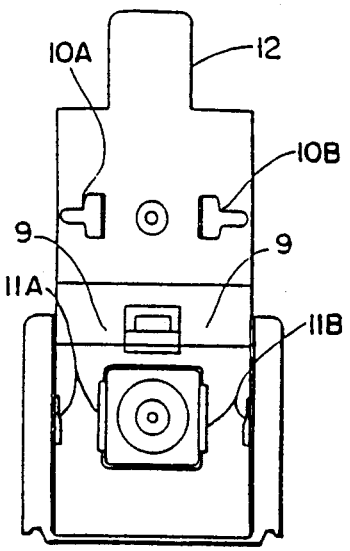
FIG. 3. The first and second nozzle of the present invention are shown in a front elevation view in FIG. 3, with first nozzle 1 in its non-attached position.

In accordance with the above goals, there is provided by the present invention a fluid discharge apparatus for imparting a stream configuration to a current of fluid.

As used herein, the term "fluid dispensing apparatus" refers to the apparatus or mechanism used to draw up a fluid from a fluid container and expel it in a desired direction and/or configuration. Thus, for a trigger-type sprayer, the fluid dispensing apparatus would be the trigger sprayer assembly. For a pump-type fluid dispenser, the fluid dispensing apparatus would be the pump mechanism.

The term "fluid container" refers to the container used to store fluid as a reservoir to be drawn upon by the fluid dispensing apparatus. Generally, this will simply be a bottle, which may be, for example, glass or plastic, and which may assume a wide range of shapes, sizes, colors, and configurations without departing from the scope of the present invention.

The term "fluid dispenser" describes the complete assembly of housing, fluid dispensing apparatus, and fluid container. In other words, the fluid dispenser is what the end user would pick up and use to dispense fluid.

The fluid discharge apparatus of the present invention includes a nozzle containing a passageway having at least two distinct portions, namely, a receiving portion for receiving the current of fluid and an issuing portion for discharging the current. The receiving portion has a substantially rectilinear cross-section, and the issuing portion has a substantially curvilinear cross-section. Fluid passing into the receiving portion and through the issuing portion of the passageway emerges therefrom in a stream configuration.

As used herein, the term "stream configuration" means a substantially coherent, cylindrical column of fluid, and is to be distinguished from a spray configuration, in which a fluid is dispersed in an expanding conical pattern.

Without being bound to any particular interpretation, it is believed that the passageway described and claimed herein achieves its effect substantially as follows: first, as a fluid current projected by a fluid dispensing apparatus, such as a trigger-type sprayer mechanism, enters the substantially rectilinear, receiving portion of the passageway, any radial spin imparted to the current by the sprayer is disrupted by the impact and interaction of the fluid current with the substantially rectilinear portion. Second, the fluid current is then shaped into a substantially coherent, non-spinning columnar or cylindrical shape by entering and passing through the substantially curvilinear portion of the passageway.

Thus, the nozzle of the present invention appears to first break up any motion of the current flow which would otherwise cause it to emerge from the passageway in a non-stream configuration, and to then re-form the current into a flow which will emerge in a stream configuration.

For purposes of providing a specific context within which to discuss the present invention, in the following discussion reference will be made to the parts or operation of a trigger-type sprayer bottle, such as is commonly used to package liquid cleaner products. However, it is to be understood that any such references are for purposes of illustration only, and in no way constitute any express or implied limitation on the scope of the present invention.

Moreover, the particular environment and manner in which the fluid current is caused to pass through the passageway of the nozzle is not critical for purposes of the present invention. Thus, in the case of a sprayer bottle, the passageway may be formed as the original sprayer nozzle; it may be provided as a separate nozzle, to be incorporated into the fluid dispensing apparatus of the sprayer bottle; it may be provided as an after-market add-on; or, it may be permanently affixed to the sprayer bottle in a manner which permits it to be reversibly associated with the discharge orifice.

Preferably, however, the passageway is formed in a nozzle which can be reversibly attached to a discharge nozzle of a fluid dispensing apparatus, such as a trigger-type sprayer mechanism, which is in turn attached to a fluid container to form a fluid dispenser such as a sprayer bottle. When the nozzle is not attached to the discharge nozzle, fluid dispensed from the fluid dispenser emerges in whatever configuration is provided for by the discharge nozzle, such as a spray. However, when the assembly is attached to the discharge nozzle, the fluid emerges therefrom as a stream.

Figure 1:
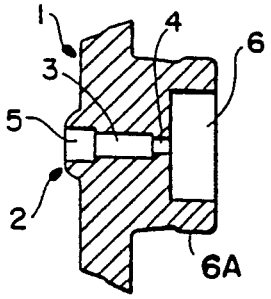
FIG. 1.

Referring now to FIG. 1, the fluid discharge apparatus according to the present invention is shown in cross-section as nozzle 1, containing a passageway 2. Passageway 2 contains at least two portions; receiving portion 3, having a substantially rectilinear cross-section, and issuing portion 4, having a substantially curvilinear cross-section.

Figure 6:
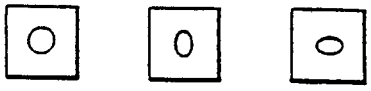
FIG. 6.
Figure 5:
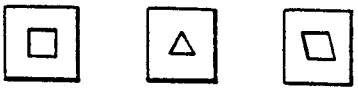
FIG. 5.
Figure 7:
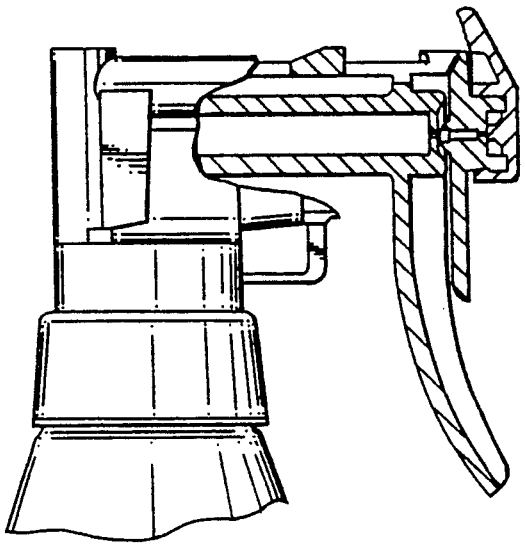
FIG. 7.

As a matter of simplicity and economy of manufacture, receiving portion 3 will generally have a substantially square cross-section and issuing portion 4 will generally have a substantially circular cross-section. However, and as shown in FIGS. 5 and 6, the cross-section of each portion may be selected from a wide range of shapes, including, for the receiving portion, a triangle, which may be isosceles, equilateral, or simply irregular; a rectangle; a trapezoid; a parallelogram; or any other suitable shape. It is to be expected that, once the number of sides of the polygon increases above a certain limit such that the polygon approaches a circle in appearance, the efficacy of the polygonal shape in disrupting the radial spin of the current of fluid will decrease. It is therefore preferred that the polygon have no more than about four sides.

Similarly, the cross section of issuing portion 4 may be chosen from a variety of suitable shapes, including circular, oval, and elliptical, as shown in FIG. 6.

The particular cross-sectional shapes shown in FIGS. 5 and 6 are of course merely illustrative, and are neither exhaustive nor limiting of the shapes which may be employed in the present invention.

If desired, passageway 2 may contain additional portions, such as sealing portion 5. The sealing portion may be of any suitable size and cross-sectional configuration, but will generally be configured to match the size and cross-section of the corresponding passageway with which the nozzle of the present invention is to be associated, in order to ensure a proper seal therebetween. The sealing portion may also serve to provide a transition for the current of fluid to pass from the fluid dispensing apparatus with which the nozzle is to be associated into the passageway.

The passageway may further include discharge portion 6, which serves to contain any initial fluid scattering as the flow emerges from the passageway, such as may be caused when the fluid at the periphery of the stream crosses the interphase from the wall of the passageway into open air.

In its preferred embodiment, the nozzle according to the present invention is a first nozzle, containing a first passageway, and is associated with a second nozzle which contains a second passageway. This second nozzle is adapted for attachment to a fluid dispensing apparatus, such as a trigger-type sprayer mechanism. The second passageway may simply passively receive the current of fluid generated by the fluid dispensing apparatus, or may form part of an assembly which generates and/or shapes that current. In particular, where the second passageway is associated with a sprayer-type fluid dispensing apparatus, the second passageway may contain or receive part or all of a spinner assembly used to provide the current of fluid with a radial spinning motion.

In particular, the second passageway may, in operation, house at least a part of a spinner assembly which functions to impart a radial spinning motion to a current of fluid as it moves along the second passageway towards the discharge orifice of the second nozzle. In such a case, the second passageway would channel the current flow to the discharge orifice from which, absent interpositioning of the first nozzle, the fluid would emerge as a spray.

Should a stream be desired instead, the first nozzle may be attached to the second nozzle such that the first passageway seals to and communicates with the second passageway. In this attached position, the current flow from the fluid dispensing apparatus passes from the second passageway into the first passageway, where it is transformed into a stream configuration in the manner previously described.

Figure 2:
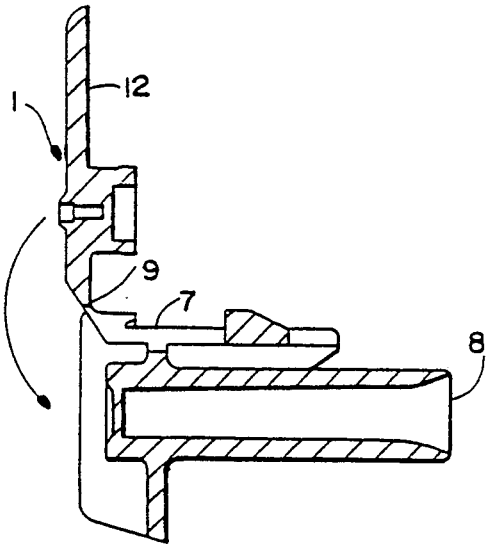
FIG. 2.

Thus, and as shown in FIG. 2, first nozzle 1 may be connected to second nozzle 7, which contains second passageway 8. The connection may take place along hinge portion 9, which may be a unitary strip or may, as shown in FIG. 3, constitute two or more distinct regions separated by an aperture. When first nozzle 1 is in the non-attached position shown in FIG. 2, it is sufficiently distanced from the terminal end of second passageway 8 to avoid interfering with the fluid emerging therefrom. Therefore, in the case of a trigger-type sprayer bottle, the radially spinning current flow would pass down second passageway 8 and emerge therefrom as a spray, without contacting first nozzle 1.

Figure 4:
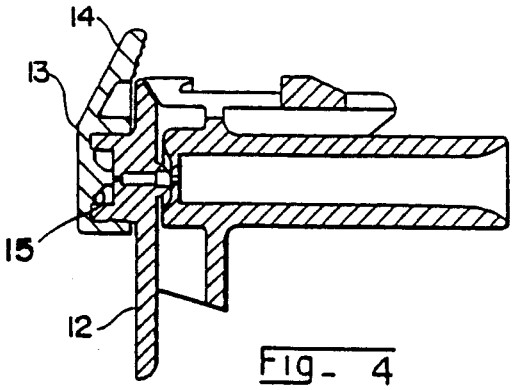
FIG. 4.

When first nozzle 1 is rotated about hinge portion 9 in the direction indicated by the arrow, sealing portion 5 of first passageway 2 is brought into sealed engagement with the terminal end of second passageway 8, as shown for example in FIG. 4. In this position the current flow, rather than emerging from the terminal end of second passageway 8 as a spray, will pass into first passageway 2 and emerge therefrom as a stream.

Locking means may be provided to maintain first passageway 2 in sealed engagement with the terminal end of second passageway 8. While any locking means may be used, it is preferred, as shown in FIG. 3, to provide a pair of locking projections 10A, 10B on first nozzle 1, and corresponding pairs of abutments 11A, 11B on second nozzle 7. When first nozzle 1 is pivoted in the direction shown by the arrow in FIG. 2, locking projections 10A, 10B engage abutments 11A, 11B, thereby maintaining first passageway 2 in sealed engagement with the terminal end of second passageway 8 until first nozzle 1 is pivoted back in the clockwise direction, disengaging the locking projections from the corresponding abutments. If desired, a projecting tab 12 may be provided on first nozzle 1 to provide a convenient means for moving first nozzle 1 between its attached and non-attached positions.

It may also be desired to provide an external cap 13, as shown in FIG. 4, adapted to seal discharge portion 6 in order to prevent any leakage during shipping and/or storage of fluid dispensers provided with the nozzle or nozzles of the present invention. The cap may be configured to snap over and around discharge portion 6, or to snap within and thus directly plug discharge portion 6. It is preferred, as shown, to configure the external cap such that it snaps over and around the discharge portion. To this end, the external circumference of discharge portion 6 may be provided with a raised or flared portion 6A (see FIG. 1). External cap 13 will then be dimensioned to tightly fit over the discharge portion, and will be provided with an inner annular ridge, positioned and dimensioned such that, as the external cap is pressed onto the discharge portion, the inner annular ridge of the cap will encounter the raised or flared portion of the discharge portion, and may, due to the elasticity of the material of the cap and/or the discharge portion, be forced over the raised or flared portion, thus causing the cap to snap securely onto the discharge portion and provide a liquid-tight seal.

The sealing effect of the cap may be enhanced by providing the cap with a projection 15 on the inner end wall thereof. The shape and size of projection 15 are selected such that, when external cap 13 is pressed onto and sealed with discharge portion 6, the terminal end of the projection is pressed against and seals the discharge orifice of first passageway 2, further preventing any fluid from leaking therefrom.

External cap 13 may further be provided with tab portion 14 to provide a convenient leverage point for snapping the cap onto and off of the discharge portion.

The nozzle of the present invention may be used in conjunction with any apparatus whose operation involves creating, projecting, or receiving a fluid current. By incorporating the nozzle into such an apparatus at a suitable location, or by associating the nozzle with such an apparatus in a suitable manner, the fluid current created, projected, or received by the apparatus may be caused to pass through the nozzle passageway, emerging therefrom in a stream configuration. In particular, the nozzle according to the present invention may be used in conjunction with any fluid dispenser, such as a squeeze bottle, a pump-type sprayer bottle, a trigger-type sprayer bottle, an aerosol-type spray dispenser, or a push-button type spray dispenser.

The present invention has of necessity been discussed herein by reference to certain specific methods, materials, and configurations. It is to be understood that the discussion of these specific methods, materials, and configurations in no way constitutes any limitation on the scope of the present invention, which extends to any and all alternative methods, materials, and configurations suitable for accomplishing the ends of the present invention.

What we claim is:

1. A fluid discharge apparatus for imparting a stream configuration to a current of fluid, said fluid discharge apparatus comprising a nozzle containing a passageway having at least a receiving portion with a substantially rectilinear cross-section and an issuing portion immediately adjacent said receiving portion, said issuing portion having a substantially curvilinear cross-section, whereby a fluid current passing sequentially through said receiving portion and said issuing portion emerges therefrom in a stream configuration.

2. The fluid discharge apparatus as defined by claim 1, wherein said receiving portion and said issuing portion are adjacent each other.

3. The fluid discharge apparatus as defined by claim 1, wherein said receiving portion has a cross section substantially in the shape of a polygon.

4. The fluid discharge apparatus as defined by claim 3, wherein said receiving portion has a cross section substantially in the shape of a regular polygon.

5. The fluid discharge apparatus as defined by claim 3, wherein said polygon is selected from the group consisting of a triangle, a rectangle, a square, a pentagon, a hexagon, a septagon, an octagon, a trapezoid, and a parallelogram.

6. The fluid discharge apparatus as defined by claim 5, wherein said triangle is selected from the group consisting of an isosceles triangle and an equilateral triangle.

7. The fluid discharge apparatus as defined by claim 1, wherein said issuing portion has a cross section selected from the group consisting of a circle, an oval, and an ellipse.

8. The fluid discharge apparatus as defined by claim 7, wherein said issuing portion has a cross section substantially in the shape of a circle.

9. The fluid discharge apparatus as defined by claim 8, wherein said receiving portion has a cross-section substantially in the shape of a polygon.

10. The fluid discharge apparatus as defined by claim 9, wherein each side of said polygon has a length at least equal to the diameter of said circle.

11. The fluid discharge apparatus as defined by claim 10, wherein the circumference of said polygon is no less than the circumference of said circle.

12. The fluid discharge apparatus as defined by claim 1, wherein said receiving portion has a cross section substantially in the shape of a square and said issuing portion has a cross section substantially in the shape of a circle.

13. A fluid discharge apparatus for imparting a stream configuration to a fluid current projected by a fluid dispensing apparatus, comprising:

a) a first nozzle, comprising a first passageway having at least a receiving portion with a substantially rectilinear cross-section and an issuing portion immediately adjacent said receiving portion, said issuing portion having a substantially curvilinear cross-section, whereby a fluid current passing sequentially through said receiving portion and said issuing portion emerges therefrom in a stream configuration, and;

b) a second nozzle having a second passageway adapted to receive the fluid current from the fluid dispensing apparatus, said second nozzle being adapted for attachment to the fluid dispensing apparatus.

14. The fluid discharge apparatus as defined by claim 13, wherein said first nozzle comprises a hinge portion flexibly connecting said first nozzle to said second nozzle, whereby said first nozzle is moveable with respect to said second nozzle between an attached position wherein said first passageway is in sealed communication with said second passageway, and a non-attached position wherein said first nozzle is sufficiently distanced from said second passageway to avoid contact with fluid emerging from said second passageway.

15. The fluid discharge apparatus as defined by claim 14, further comprising means for maintaining said first passageway in sealed communication with said second passageway.

16. The fluid discharge apparatus as defined by claim 15, wherein said means for maintaining comprises at least one locking projection on said first nozzle and at least one pair of abutments on said second nozzle, said locking projection and said pair of abutments being configured and positioned such that rotation of said first nozzle about said hinge portion to bring said first passageway into sealed communication with said second passageway causes said locking projection and said pair of abutments to become operatively engaged, whereby said first nozzle is maintained in said attached position.

17. The fluid discharge apparatus as defined by claim 16, further comprising two locking projections on said first nozzle and two corresponding pairs of abutments on said second nozzle.

18. The fluid discharge apparatus as defined by claim 13, wherein said first nozzle further comprises at least one projecting tab for rotating said first nozzle about said hinge portion.

19. The fluid discharge apparatus as defined by claim 13, wherein said receiving portion and said issuing portion are adjacent each other.

20. The fluid discharge apparatus as defined by claim 19, wherein said receiving portion has a cross section substantially in the shape of a polygon.

21. The fluid discharge apparatus as defined by claim 20, wherein said polygon is a square.

22. The fluid discharge apparatus as defined by claim 21, wherein said issuing portion has a cross section substantially in the shape of a circle.

23. A fluid dispenser comprising a fluid container, a fluid dispensing apparatus adapted for attachment to said fluid container, and the fluid discharge apparatus as defined by claim 13, wherein said second nozzle is adapted for attachment to said fluid dispensing apparatus.

24. The fluid dispenser as defined by claim 23, further comprising means for sealing said first passageway to prevent fluid from discharging therefrom during shipping or storage of said fluid dispenser.

25. The fluid dispenser as defined by claim 24, wherein said first passageway comprises a discharge portion where the current of fluid passes from said first passageway into the ambient environment, and wherein said means for sealing comprises an external cap adapted to sealingly attach to said discharge portion.

26. The fluid dispenser as defined by claim 25, wherein said discharge portion comprises a cylindrical projection having an exterior raised annulus and wherein said external cap comprises an interior raised annulus, said interior raised annulus being so positioned and dimensioned on said external cap as to first engage and then snap over said exterior raised annulus when said external cap is pressed onto said discharge portion, thereby sealing said first passageway.

27. The fluid dispenser as defined by claim 26, said external cap further comprising a projection on the interior end wall thereof, said projection being positioned and configured so as to sealingly engage the discharge orifice of said first passageway when said external cap is pressed onto and sealed to said discharge portion.

28. A fluid discharge apparatus for imparting a stream configuration to a radially spinning fluid current generated by a sprayer-type fluid dispenser, comprising:

a) a second nozzle having a second passageway adapted to receive the fluid current, said second nozzle being adapted for attachment to the sprayer-type fluid dispenser; and b) a first nozzle containing a first passageway, said first nozzle being connected to said second nozzle and further being moveable with respect to said second nozzle between an attached position wherein said first passageway is in sealed communication with said second passageway, and a non-attached position wherein said first nozzle is sufficiently distanced from said second passageway to avoid contact with fluid emerging from said second passageway, said first passageway comprising:

i) a second, substantially circular portion adapted to receive the fluid current from said second passageway when said first nozzle is connected to and communicating with said second passageway;

ii) a first, substantially polygonal portion communicating with said second, substantially circular portion; and iii) a second, substantially circular portion communicating with said first, substantially polygonal portion, whereby the radially spinning fluid current passes from said second passageway into said second, substantially circular portion; is substantially deprived of coherent radial spin upon entering and passing through said first, substantially polygonal portion; and is re-formed into a substantially non-spinning, cylindrical fluid current upon entering and passing through said second, substantially circular passageway, thereby emerging from said second, substantially circular passageway as a substantially coherent, cylindrical fluid stream.

* * * * *